US006480687B1

(12) United States Patent
Kawai et al.

(10) Patent No.: US 6,480,687 B1
(45) Date of Patent: Nov. 12, 2002

(54) PROCESS CARTRIDGE, HANDLE ATTACHING METHOD AND ELECTROPHOTOGRAPHIC IMAGE FORMING APPARATUS

(75) Inventors: Tachio Kawai; Kanji Yokomori, both of Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/668,373

(22) Filed: Sep. 25, 2000

(30) Foreign Application Priority Data

Sep. 27, 1999 (JP) ..... 11-272648
Sep. 12, 2000 (JP) ..... 2000-276419

(51) Int. Cl.[7] ..... G03G 21/16
(52) U.S. Cl. ..... 399/111; 399/117
(58) Field of Search ..... 399/107, 108, 399/110, 111, 116, 117

(56) References Cited

U.S. PATENT DOCUMENTS 5,204,713 A * 4/1993 Yamamura ..... 399/119
5,287,145 A * 2/1994 Ohtsuka ..... 399/100
5,347,343 A * 9/1994 Ohtsuka et al. ..... 399/111
5,457,520 A * 10/1995 Schell et al. ..... 384/419
5,768,659 A * 6/1998 Kameda ..... 399/111
5,839,028 A 11/1998 Nomura et al. ..... 399/109
5,878,309 A 3/1999 Nomura et al. ..... 399/111
5,903,803 A 5/1999 Kawai et al. ..... 399/116
5,937,240 A 8/1999 Kanno et al. ..... 399/111
5,940,657 A 8/1999 Yokomori et al. ..... 399/119
5,943,528 A 8/1999 Akutsu et al. ..... 399/110
5,950,049 A 9/1999 Yokomori et al. ..... 399/119
5,953,562 A 9/1999 Kawaguchi et al. ..... 399/117
6,029,031 A 2/2000 Yokomori et al. ..... 399/109
6,055,406 A 4/2000 Kawai et al. ..... 399/360
6,064,843 A 5/2000 Isobe et al. ..... 399/111
6,072,969 A 6/2000 Yokomori et al. ..... 399/119
6,115,567 A 9/2000 Kawai et al. ..... 399/106
6,128,454 A 10/2000 Kawai et al. ..... 399/116
6,249,661 B1 * 6/2001 Saitoh et al. ..... 399/117

FOREIGN PATENT DOCUMENTS

JP 63-191363 12/1988
JP 2-69365 5/1990

(List continued on next page.)

*Primary Examiner*—Robert Beatty
(74) *Attorney, Agent, or Firm*—Fitzpatrick, Cella, Harper & Scinto

(57) ABSTRACT

A process cartridge detachably mountable to a main body of an electrophotographic image forming apparatus includes an electrophotographic photosensitive drum; a process device acting on the electrophotographic photosensitive drum; a cartridge frame for supporting the photosensitive drum; a first bearing member which is arranged in the cartridge frame and rotatably supports a shaft projected from one end of the photosensitive drum in its longitudinal direction, and has a first exposure portion exposed from the cartridge frame; and a second bearing member which is arranged in the cartridge frame and rotatably supports a shaft projected from the other end of the photosensitive drum in its longitudinal direction, and has a second exposure portion exposed from the cartridge frame;. The first exposure portion formed in the first bearing member comes in contact with a first main body positioning portion formed in the apparatus main body and is positioned, and the second exposure portion formed in the second bearing member comes in contact with a second main body positioning portion formed in the apparatus main body and is positioned when the cartridge is mounted to the apparatus main body.

30 Claims, 11 Drawing Sheets

FOREIGN PATENT DOCUMENTS

| | | | |
|---|---|---|---|
| JP | 02-253287 | * | 10/1990 |
| JP | 2-148167 | | 12/1990 |
| JP | 02-300769 | * | 12/1990 |
| JP | 3-94283 | | 4/1991 |
| JP | 04-078888 | * | 3/1992 |
| JP | 5-134482 | | 5/1993 |
| JP | 07-160172 | * | 9/1995 |
| JP | 7-325530 | | 12/1995 |
| JP | 7-325534 | | 12/1995 |
| JP | 8-16069 | | 1/1996 |
| JP | 8-76667 | | 3/1996 |
| JP | 8-320634 | | 12/1996 |
| JP | 10-74031 | | 3/1998 |
| JP | 10-153940 | | 6/1998 |

* cited by examiner

PROCESS CARTRIDGE, HANDLE ATTACHING METHOD AND ELECTROPHOTOGRAPHIC IMAGE FORMING APPARATUS

BACKGROUND OF THE INVENTION

1. Field of the Invention

The present invention relates to an electrophotographic image forming apparatus, a process cartridge detachably mountable to the electrophotographic image forming apparatus, and a handle attaching method.

Here, the electrophotographic image forming apparatus forms an image on a recording medium by using an electrophotographic image forming process, and includes e.g., an electrophotographic copying machine, an electrophotographic printer (e.g., an LED printer, a laser-beam printer, etc.), an electrophotographic facsimile machine, an electrophotographic word processor, etc.

In the process cartridge, charging means, developing means or cleaning means as process means and an electrophotographic photosensitive drum are integrally made into a cartridge, and this cartridge is detachably mountable to a main body of the electrophotographic image forming apparatus. The electrophotographic photosensitive drum and at least one of the charging means, the developing means and the cleaning means as the process means are also integrally made into a cartridge, and this cartridge is detachably mountable to the main body of the electrophotographic image forming apparatus. Further, at least the developing means as the process means and the electrophotographic photosensitive drum are integrally made into a cartridge, and this cartridge is detachably mountable to the main body of the electrophotographic image forming apparatus. Further, the handle is arranged to be gripped by a user when the process cartridge is detached from and attached to the above apparatus main body.

2. Related Background Art

An electrophotographic image forming apparatus using an electrophotographic image forming process conventionally adopts a process-cartridge system in which an electrophotographic photosensitive drum and process means acting on this electrophotographic photosensitive drum are integrally made into a cartridge, and this cartridge is detachably mountable to a main body of the image forming apparatus. In accordance with this process cartridge system, the apparatus can be personally maintained by a user instead of a service man for maintenance so that operability can be greatly improved. Therefore, this process cartridge system is widely used in the image forming apparatus.

In such a process cartridge, a flange having a shaft member extended outside the electrophotographic photosensitive drum is attached to each of both side end portions of the electrophotographic photosensitive drum, and this shaft member is rotatably positioned and secured to a frame (referred to as cartridge frame) of the process cartridge through a bearing member.

The present invention is made by further developing the above related art.

SUMMARY OF THE INVENTION

An object of the present invention is to provide a process cartridge, a handle attaching method and an electrophotographic image forming apparatus for improving the positioning accuracy of an electrophotographic photosensitive drum with respect to an apparatus main body when the process cartridge is mounted to the apparatus main body.

Another object of the present invention is to provide a process cartridge, a handle attaching method and an electrophotographic image forming apparatus for improving the positioning accuracy of the process cartridge with respect to an apparatus main body when the process cartridge is mounted to the apparatus main body.

Another object of the present invention is to provide a process cartridge, a handle attaching method and an electrophotographic image forming apparatus to which the process cartridge is detachably mountable, in which the number of parts is reduced.

Another object of the present invention is to provide a process cartridge excellent in detachable attachment operability, a handle used in this process cartridge, an attaching method of this handle, and an electrophotographic image forming apparatus to which the above process cartridge is detachably mountable.

Another object of the present invention is to provide a process cartridge having a handle having a function for regulating the disconnection of a bearing portion from a frame, the handle used in this process cartridge, an attaching method of this handle, and an electrophotographic image forming apparatus to which the above process cartridge is detachably mountable.

Another object of the present invention is to provide a process cartridge improved in assembly property, a handle used in this process cartridge, an attaching method of this handle, and an electrophotographic image forming apparatus to which the above process cartridge is detachably mountable.

Another object of the present invention is to provide a process cartridge and an electrophotographic image forming apparatus to which the process cartridge is detachably mountable, in which a first exposure portion of a first bearing member comes in contact with a first main body positioning portion formed in the main body of the apparatus and is positioned, and a second exposure portion of a second bearing member comes in contact with a second main body positioning portion formed in the main body and is positioned when the process cartridge is mounted to the main body of the apparatus.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

The embodiments of the present invention will next be described concretely on the basis of the accompanying drawings.

Figure 1:
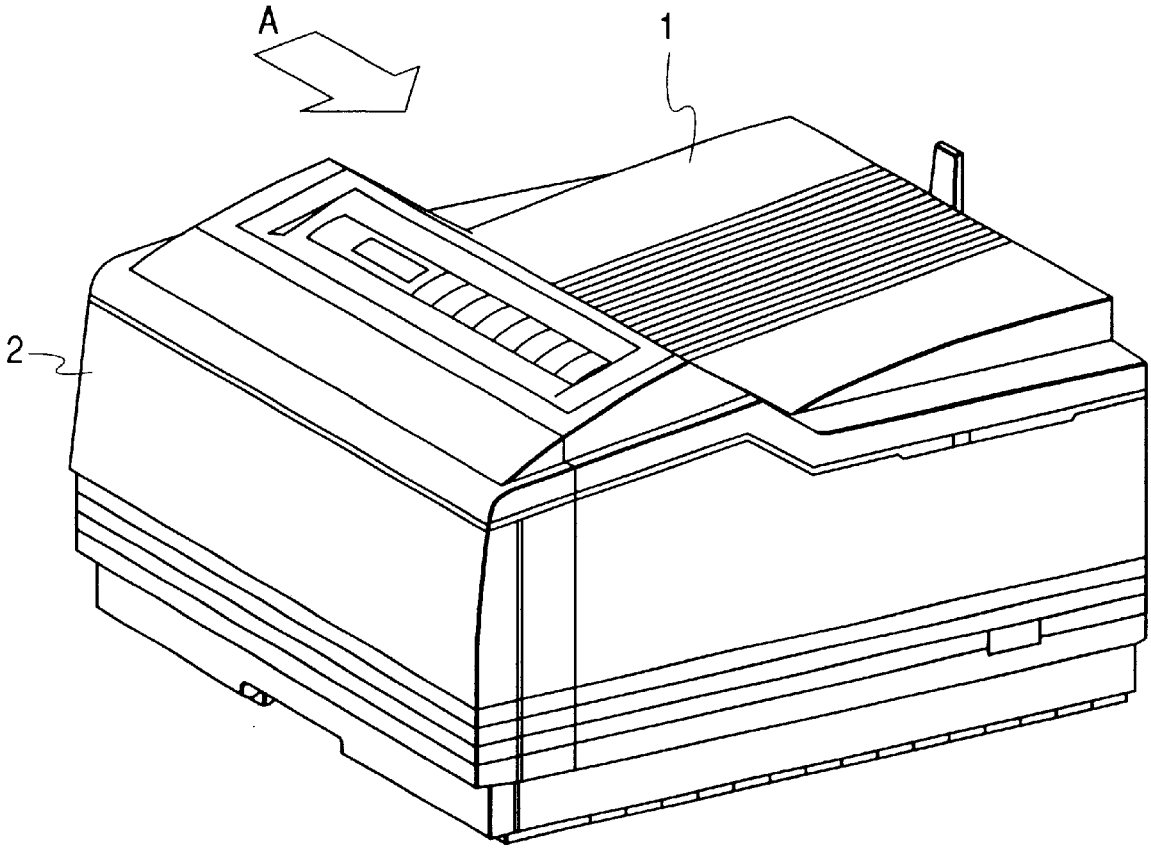
FIG. 1 is a perspective view showing the external appearance of an electrophotographic image forming apparatus.
Figure 2:
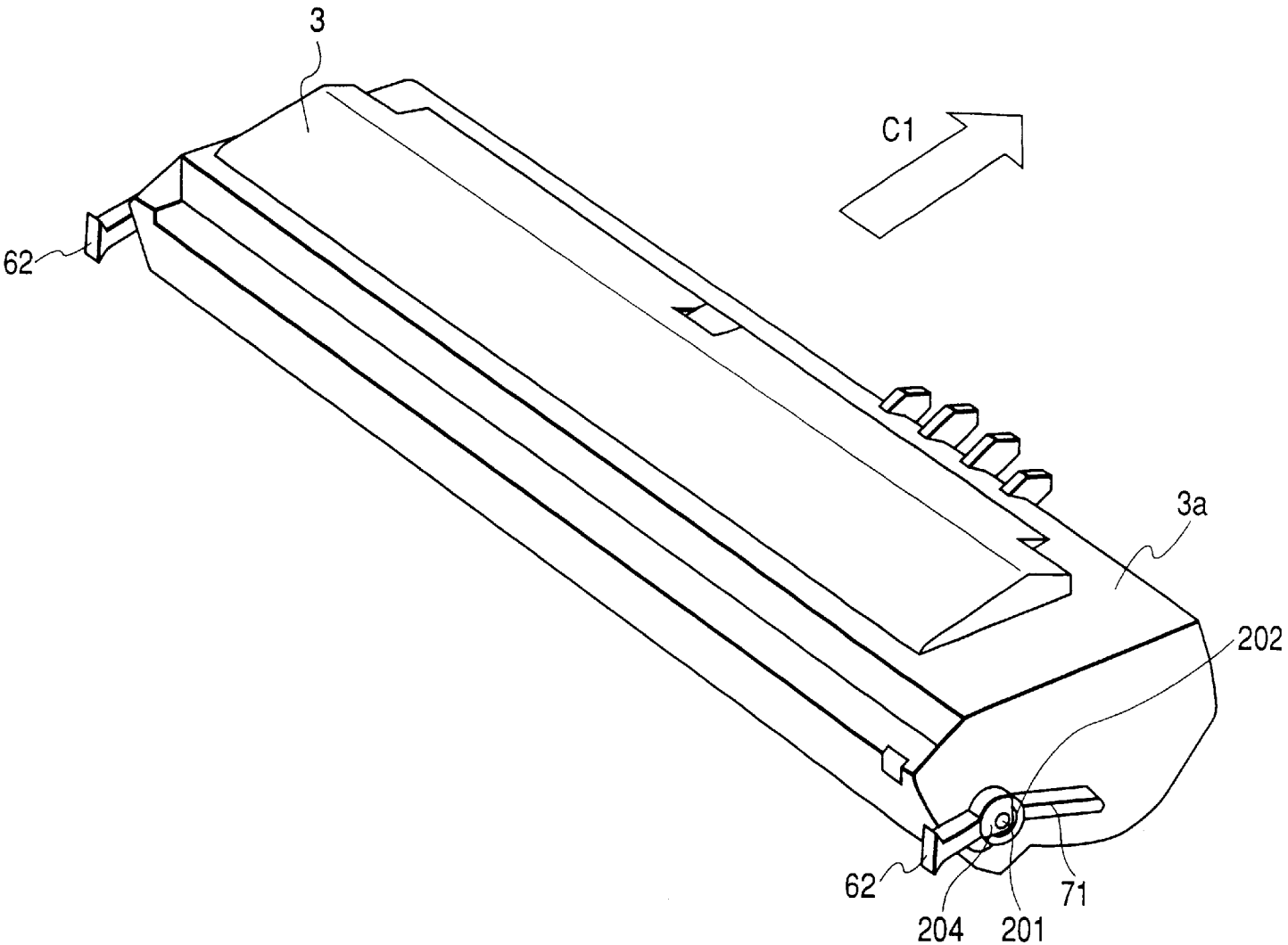
FIG. 2 is a perspective view showing the external appearance of a process cartridge.

FIG. 1 is a perspective view showing the external appearance of a laser beam printer as an example of an electrophotographic image forming apparatus of the present invention. FIG. 2 is a perspective view showing the external appearance of a process cartridge 3 constructed such that the process cartridge 3 is detachably mountable to an apparatus main body 1 by opening a front door 2 of a main body of this printer. This process cartridge 3 contains an electrophotographic photosensitive drum, charging means for uniformly charging this photosensitive drum, developing means for developing an electrostatic latent image formed on this photosensitive drum, and cleaning means for removing toner left on this photosensitive drum. The process cartridge may have the electrophotographic photosensitive drum and at least one of the charging means, the developing means and the cleaning means as process means, and is detachably mountable to the main body 1 of the electrophotographic image forming apparatus.

Figure 3:
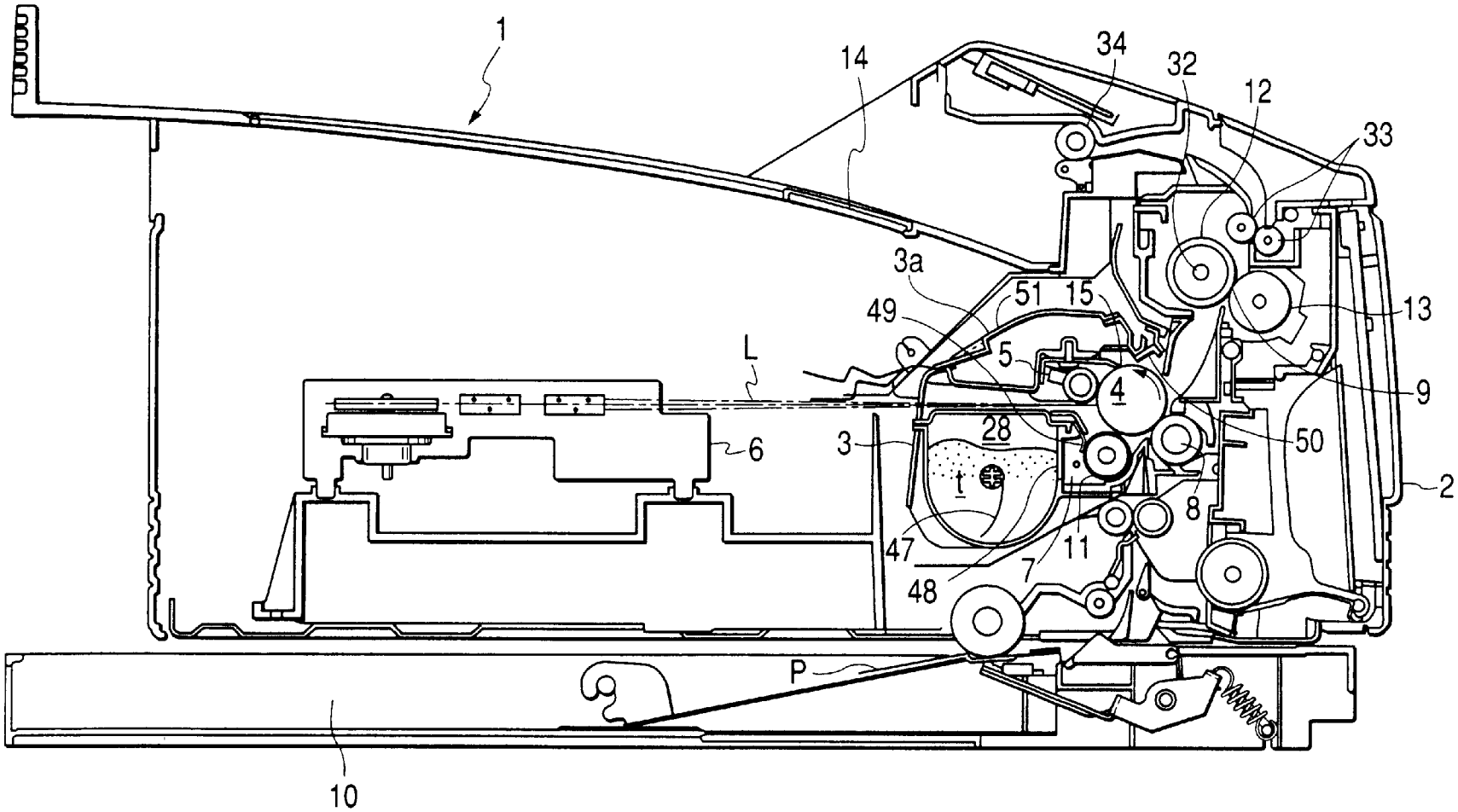
FIG. 3 is a vertical sectional view of the process cartridge when the process cartridge is mounted to an apparatus main body.
Figure 4:
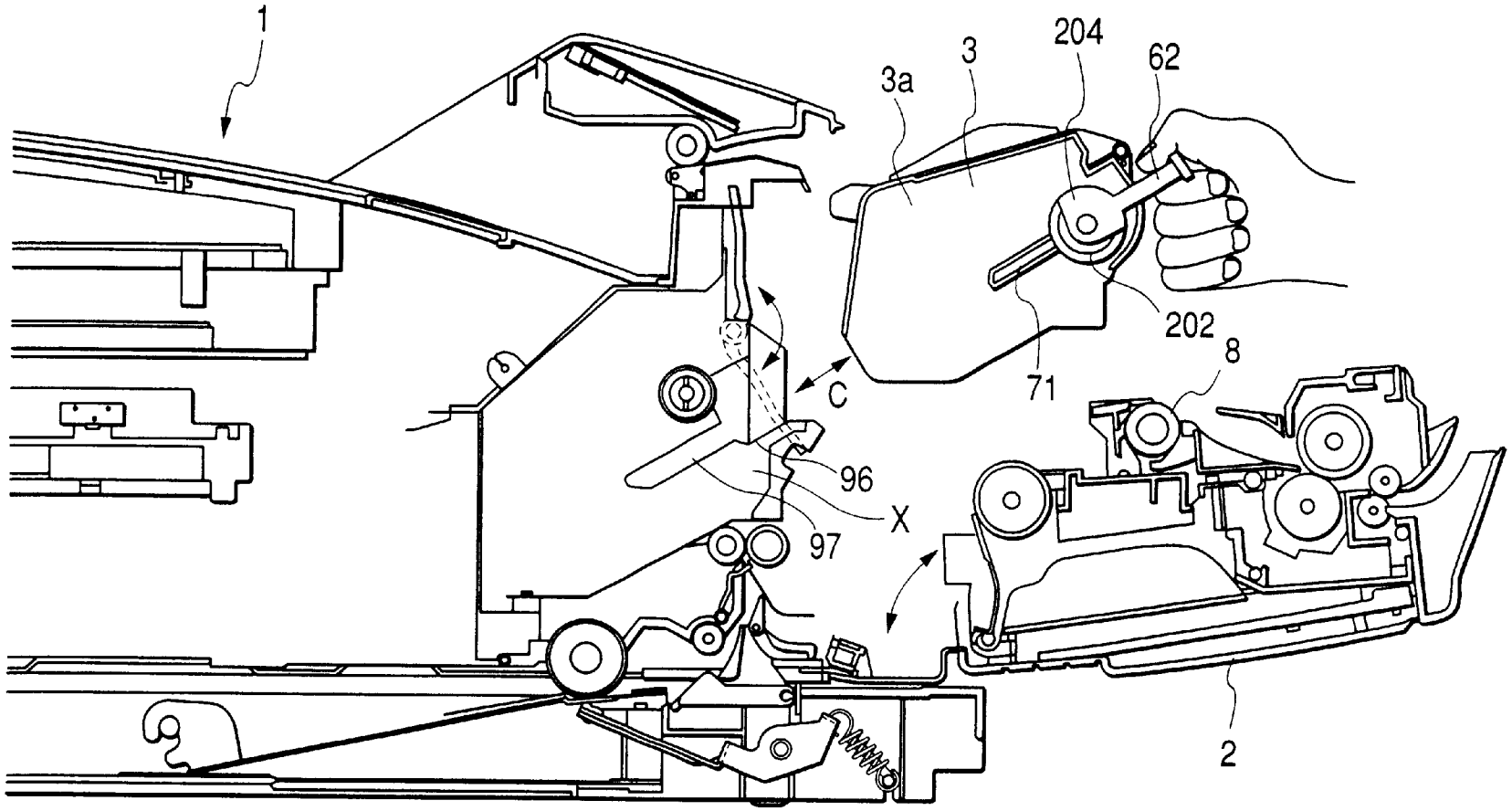
FIG. 4 is a vertical sectional view showing a state in which the process cartridge is mounted to and dismounted from the apparatus main body.

FIG. 3 is a cross-sectional view (seen from the direction indicated by an arrow A in FIG. 1) of the process cartridge 3 when the process cartridge 3 is mounted to the apparatus main body 1. FIG. 4 is a cross-sectional view showing a state in which the process cartridge 3 is mounted and dismounted in a direction indicated by an arrow C1 of FIG. 2 and a direction indicated by an arrow C of FIG. 4 by opening a front door 2 of the apparatus main body 1.

An image forming process of the image forming apparatus will first be schematically explained with reference to FIG. 3.

The electrophotographic photosensitive drum (hereinafter referred to as photosensitive drum) 4 has a photosensitive layer (photoconductor) on its surface, and the surface of the photosensitive drum 4 is uniformly charged by a charging roller 5 as charging means. Next, a laser beam L from a laser optical unit 6 irradiates the photosensitive drum 4 on the basis of image information inputted from an external computer, etc. Thus, an electrostatic latent image according to the image information is formed on the photosensitive drum 4. Next, in a developing portion 7, a portion of the photosensitive drum 4 irradiated by the laser beam L is developed (in reversal development) with toner t having the same polarity as a charging polarity of the photosensitive drum 4. Thus, a toner image is formed on the photosensitive drum 4. Next, a recording medium (e.g., a recording paper sheet, an OHP, etc.) P supplied from a feed cassette 10 is nipped between the photosensitive drum 4 and a transfer roller 8 in synchronism with reaching timing of the toner image reaching a transfer position formed by the photosensitive drum 4 and the transfer roller 8. The toner image is then transferred to the recording medium P. This recording medium P is nipped by a nip 9 formed by a fixing roller 12 having a heater 32 and a pressure roller 13, and the toner image is fixed to the recording medium P. Thereafter, the recording medium P is discharged onto a discharge tray 14 by discharge rollers 33, 34. After the transfer is terminated, the residue such as the remaining toner, etc. is removed from the photosensitive drum 4 by a cleaning blade 5 as cleaning means, and it again proceeds to the charging process.

The process cartridge 3 as an image forming portion will next be explained.

An electrophotographic image forming process is used as an image forming method when this process cartridge 3 is mounted to the apparatus main body 1. The construction of the process cartridge 3 will next be explained in accordance with this process.

A primary charging portion is arranged upstream of an exposure position of the laser beam L. In this embodiment, a charging roller 5 as a semiconductive elastic body able to be rotated by the rotation of the photosensitive drum 4 abuts on the photosensitive drum 4 at a predetermined pressure. For example, this charging roller 5 can uniformly charge a surface of the photosensitive drum 4 in a voltage range from −600 V to −700 V by applying, for example, a bias voltage from DC −600 V to DC −700 V and a bias voltage from AC 1200 V to AC 1800 V to the charging roller 5.

An electrostatic latent image is next formed by a laser beam optical system. The electric potential of an electrostatic latent image portion is changed to a range from −500 V to −150 V.

On the other hand, the toner t of the same polarity as the primary charge is drawn up by an agitating member 47 from a toner container 28, and is sent into a developing portion 7 from an opening 48. The surface of a developing roller 11 as developing means is thinly and uniformly coated with the toner t frictionally charged by the rubbing of a developing blade 49. This toner t is developed on the surface of the photosensitive drum 4 in accordance with the above electrostatic latent image by applying a bias voltage to the developer roller 11, and is visualized as a toner image on the surface of the photosensitive drum 4.

The toner image on the photosensitive drum 4 is then transferred onto the recording medium P by a bias voltage of the transfer roller 8 as mentioned above.

On the other hand, the remaining toner t left in the process of the transfer on the surface of the photosensitive drum 4 passes through a dip sheet 50 arranged in the inlet of a cleaning portion, and is scraped off by a cleaning blade 15, and is collected within a cleaning container 51. The next image forming process can be again performed in the cleaned photosensitive drum 4.

The process cartridge 3 is replaced with a new process cartridge when the contained toner t is depleted for the image formation and no satisfactory image for a user can be formed. When the front door 2 of the apparatus main body 1 is opened in this replacement, the process cartridge 3 can be taken out of the apparatus main body 1 in a direction perpendicular to an axial direction of the photosensitive drum 4. The front door 2 is closed after the new process cartridge 3 is mounted to the apparatus main body 1. Thus, the process cartridge 3 is set to a predetermined position by pressing of the transfer roller 8, etc. The above process cartridge is personally replaced by a user.

{Supporting Construction of Photosensitive Drum}

A supporting construction of the photosensitive drum 4 of the process cartridge 3 will next be explained in detail with reference to FIGS. 5 and 6. In the following explanation, indexes a, b suffixed to the reference numerals may be omitted when a similar construction is formed on left-hand and right-hand sides.

Figure 5:
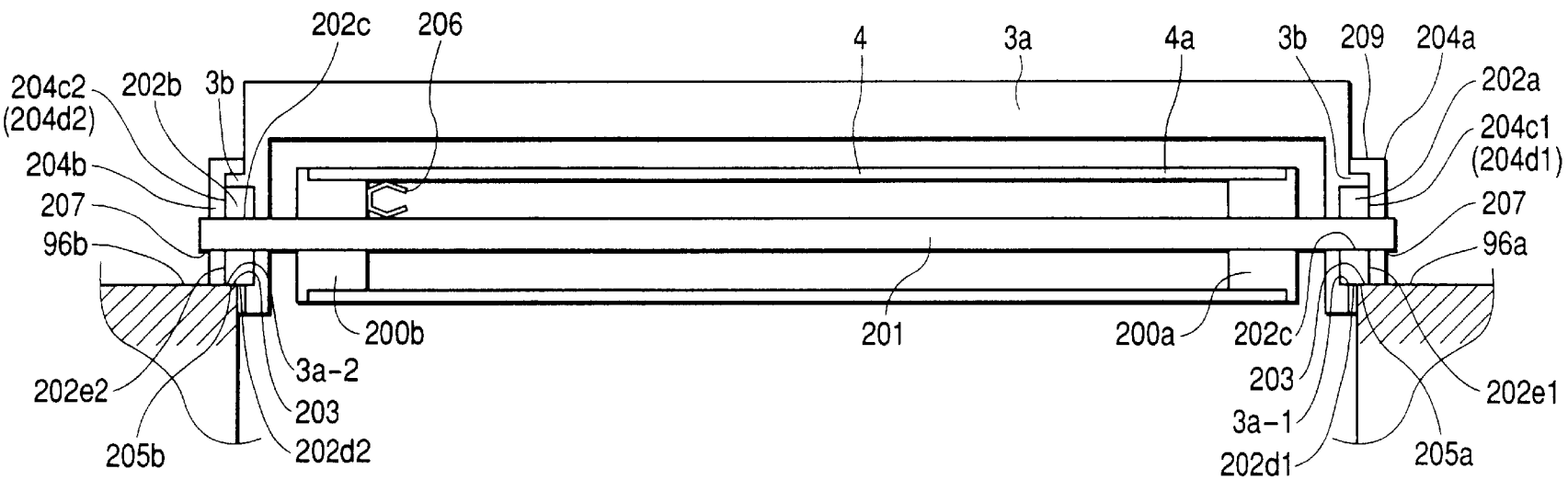
FIG. 5 is a front sectional view showing the supporting construction of a photosensitive drum.

FIG. 5 is a front view of the supporting construction of the photosensitive drum in an embodiment to which the present invention is applied. FIG. 6 is a perspective view near a bearing member and a handle in the embodiment to which the present invention is applied.

Figure 6:
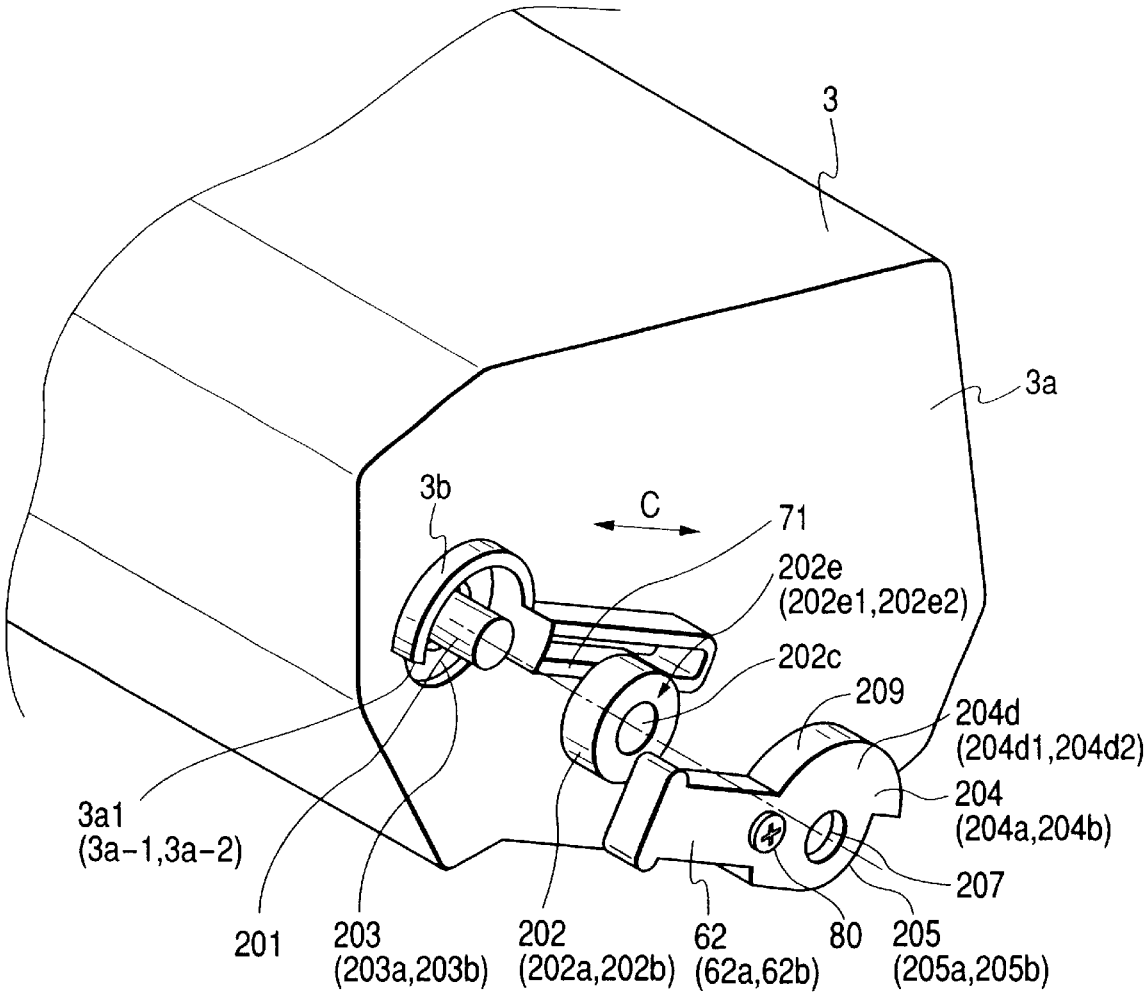
FIG. 6 is an exploded perspective view near a handle.

As shown in FIGS. 5 and 6, in the photosensitive drum 4, a flange 200 (200*a*, 200*b*) is fixedly attached by a method of adhesion or caulking, etc. to each of both ends of an aluminum cylindrical member 4*a* forming a photosensitive layer on its circumferential face. A shaft 201 is fitted into each of central holes of the flanges 200*a*, 200*b*. The shaft 201 is a through shaft and is inserted into the aluminum cylindrical member 4*a*, and one end and the other end of this shaft 201 are projected outside the photosensitive drum 4. Rotation and axial movement of the shaft 201 are prevented such that the shaft 201 does not slide together with the flanges 200*a*, 200*b* (not shown). The shaft 201 is a conductive metallic bar. A drum earth electrode 206 coming in contact with an inner circumferential face of the photosensitive drum 4 and the shaft 201 is attached to one of the flanges 200*a*, 200*b*. Otherwise, the flanges 200*a*, 200*b* are set to be conductive. Thus, the photosensitive drum 4 is grounded to the apparatus main body 1 through the shaft 201 and a bearing member 202*a* or 202*b* fitted onto the shaft 201. Here, when one or both of the bearing members 202*a*, 202*b* are conductive bearings, e.g., metallic bearings, these bearings are rolling bearings and metal bushes. When one or both of the bearing members 202*a*, 202*b* are synthetic resin bearings, these bearings are synthetic resin bearings containing a carbon filler, etc.

In the above photosensitive drum 4, an outer circumference of the shaft 201 is fitted into the inner circumference of a hole 202*c* of each of the bearing members 202*a*, 202*b*, and each of outer circumferences of the bearing members 202*a*, 202*b* is fitted into a concave portion 203 formed in the cartridge frame 3*a*. Thus, the photosensitive drum 4 is rotatably positioned with respect to the cartridge frame 3*a*.

Figure 7:
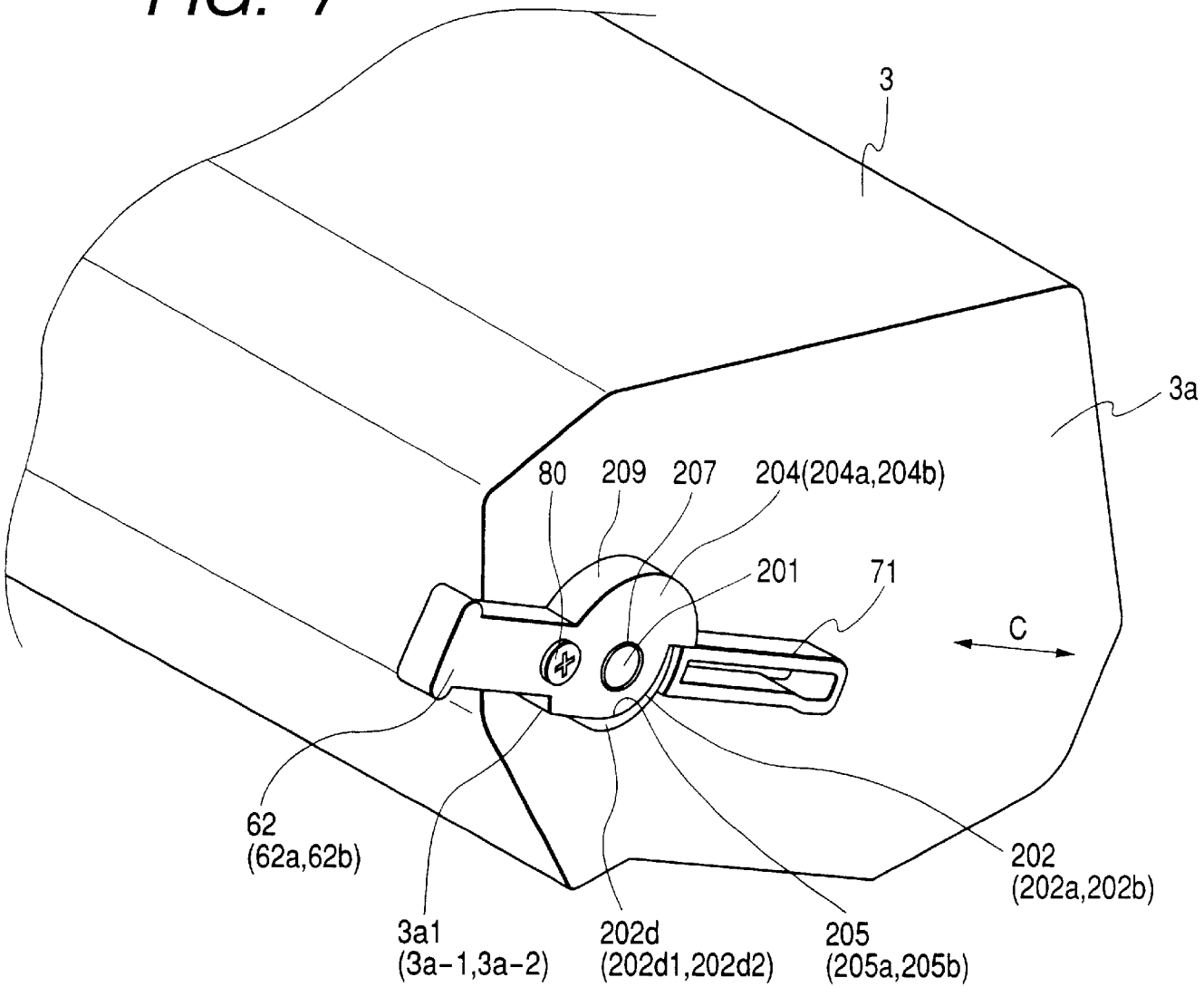
FIG. 7 is a perspective view near the handle.
Figure 8:
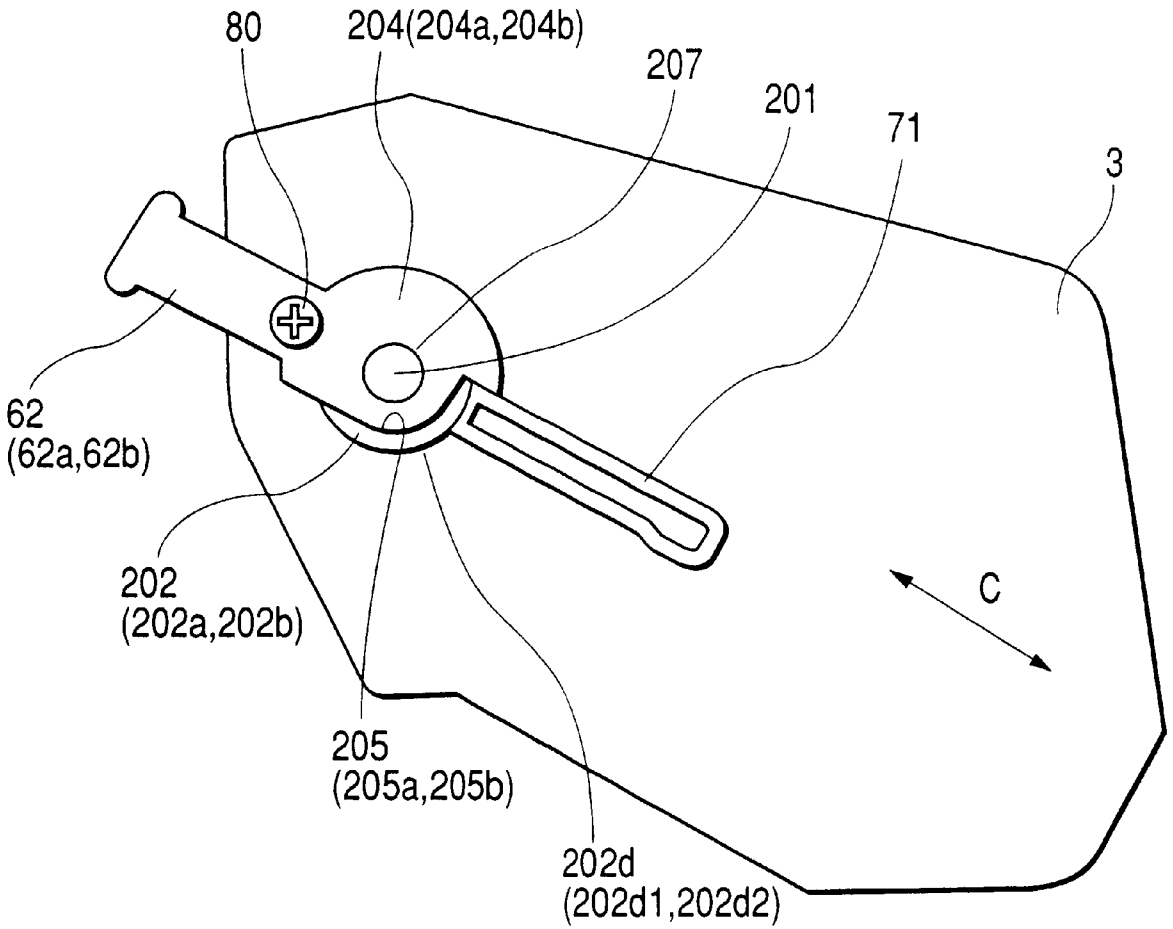
FIG. 8 is a side view near the handle.

Further, a handle 204 is fixed to the cartridge frame so as to cover the outer circumference and an outside face of each of the bearing members 202*a*, 202*b* to prevent the bearing member 202 (202*a*, 202*b*) from falling off from the concave portion 203 formed in the cartridge frame 3*a*. A notch portion 205 (205*a*, 205*b*) is formed by notching one portion of the handle 204. In a state in which the handle 204 is fixed to the cartridge frame 3*a*, portions of circumferential faces of the bearing members 202*a*, 202*b* are respectively exposed from notch portions 3*a*-1, 205*a* and notch portions 3*a*-2, 205*b*. In FIGS. 7 and 8, reference numeral 202*d* (202*d*1, 202*d*2) designates an exposure portion, i.e., a portion in which the bearing members 202*a*, 202*b* are exposed from a notch portion 3*a*1 (3*a*-1, 3*a*-2) of the cartridge frame 3*a* and a notch portion 205 (205*a*, 205*b*) of the handle 204 (204*a*, 204*b*). In this embodiment, the notch portion is not limited to a cut-out portion after molding, but, for example, also includes a case in which the cartridge frame is molded or constructed from the beginning without any portion corresponding to the notch portion.

When the process cartridge 3 is mounted to the apparatus main body, the photosensitive drum 4 is supported with respect to the apparatus main body 1 by directly engaging the exposure portion 202*d* of each of the bearing members 202*a*, 202*b* exposed from the cartridge frame 3*a* and the above notch portions 205*a*, 205*b* with a main body positioning portion 96 (96*a*, 96*b*). The main body positioning portion 96 (96*a*, 96*b*) is directly formed in a frame of the apparatus main body 1 manufactured by a sheet metal. Accordingly, when the process cartridge 3 is mounted to the apparatus main body 1, the process cartridge 3 is positioned with respect to the apparatus main body 1 with the photosensitive drum 4 as a center. Further, in this embodiment, the bearing portion 202 supporting the shaft 201 of the photosensitive drum 4 is directly positioned with respect to the main body positioning portion 96. Accordingly, the positioning accuracy of the photosensitive drum 4 and the process cartridge 3 with respect to the apparatus main body 1 are further improved.

As shown in FIG. 6, a rib 3*b* is formed in an arc shape such that the rib 3*b* surrounds an upper portion around the concave portion 203 (203*a*, 203*b*) formed at each of one end and the other end of the cartridge frame 3*a* in its longitudinal direction. (Only one end of the cartridge frame 3*a* is shown in FIG. 6.) A projected guide rib portion 71 is extended in mounting and dismounting directions (the directions indicated by an arrow C) of the process cartridge 3 on a front side (a downstream side) of the concave portion 203 in a mounting direction of the process cartridge 3. In a state in which the bearing member 202 is fitted into the concave portion 203, as shown in FIG. 5, an outside face 202*e* (202*e*1, 202*e*2) of the bearing member 202, an inside face 204*c* (204*c*1, 204*c*2) of the handle 204, and a projecting end face of the rib 3*b* are approximately in conformity with each other. Namely, a regulating portion 204*d* (204*d*1, 204*d*2) on the inside face 204*c* of the handle 204 comes in contact with the outside face 202*e* (202*e*1, 202*e*2) of the bearing member 202, and regulates the bearing member 202 so that the bearing member 202 is not disconnected from the cartridge frame 3*a*.

The handle 204 has a hole 207 fitted onto the shaft 201, the regulating portion 204*d* coming in contact with the outside face 202*e* (202*e*1, 202*e*2) of the bearing member 202, an arc shape cover portion 209 fitted onto an outer circumference of the rib 3*b*, and a gripping portion 62 continuously connected to the arc shape cover portion 209. The hole 207 fitted onto the shaft 201 is formed in the regulating portion 204*d*. No arc shape cover portion 209 is formed in the aforementioned notch portion 205. The gripping portion 62, i.e., the handle 204 is fixed to the cartridge frame 3*a* by a screw. Reference numeral 80 designates this screw (see FIGS. 6 to 10). The handle 204 may be also attached to the cartridge frame 3*a* by e.g., adhesion or snap fit, etc. In this embodiment, the handle 204 can be detached from the frame 3*a* by unfastening the screw 80.

Figure 11:
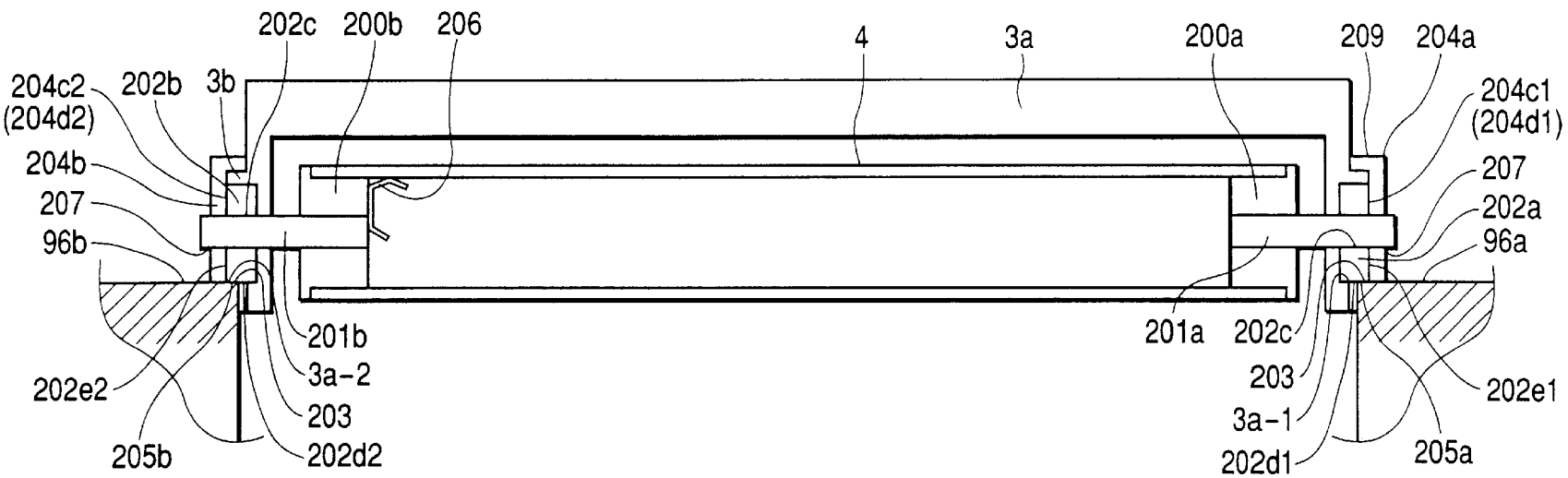
FIG. 11 is a front sectional view showing another embodiment of a drum shaft.

FIG. 11 shows another embodiment.

In the above description, the shaft 201 is set to an integral through shaft. However, the shaft 201 is not limited to the integral through shaft, but may be also formed toward the exterior of the photosensitive drum 4 in each of the central holes of the above flanges 200*a*, 200*b*. Namely, the shaft 201 may be also set to each of separate shafts 201*a*, 201*b* respectively fixed to the aforementioned flanges 200*a*, 200*b*. When the flanges 200*a*, 200*b* and the shafts 201*a*, 201*b* are respectively fixed to each other, e.g., the shafts 201*a*, 201*b* are respectively press-fitted into the flanges 200*a*, 200*b*.

{Positioning method at process cartridge mounting time}

As shown in FIG. 4, mounting and dismounting operations of the process cartridge 3 with respect to the apparatus main body 1 are performed by gripping the gripping portion 62 (62*a*, 62*b*) formed in the handle 204 by a user. The user grips this gripping portion 62 and sets the gripping portion 62 in a state in which a cartridge mounting portion X secured within the apparatus main body 1 is set to a target. This mounting operation of the process cartridge 3 can be exactly performed by using positioning and guide means described below.

Figure 9:
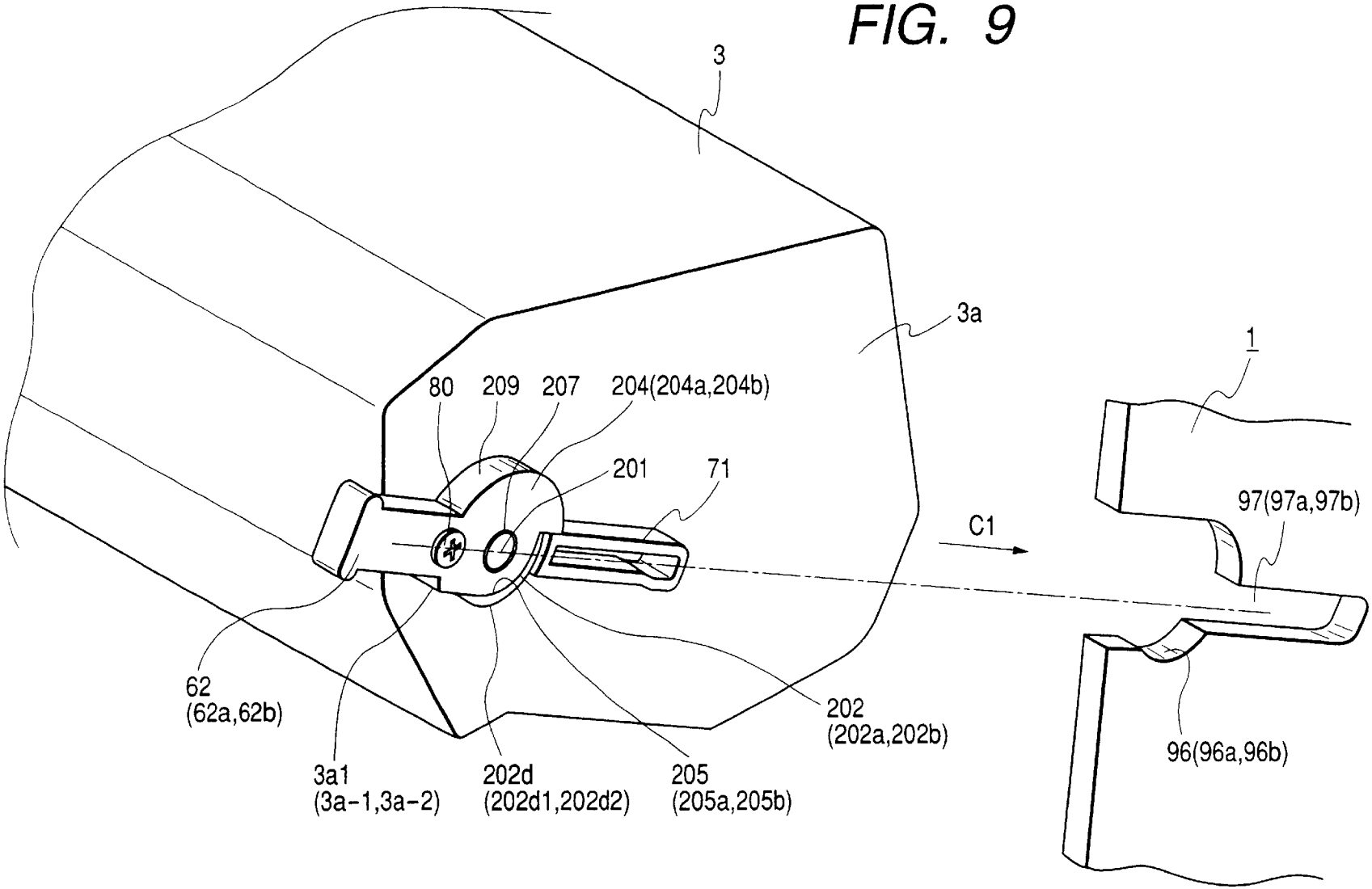
FIG. 9 is a perspective view showing a state in which the process cartridge is mounted to the apparatus main body.
Figure 10:
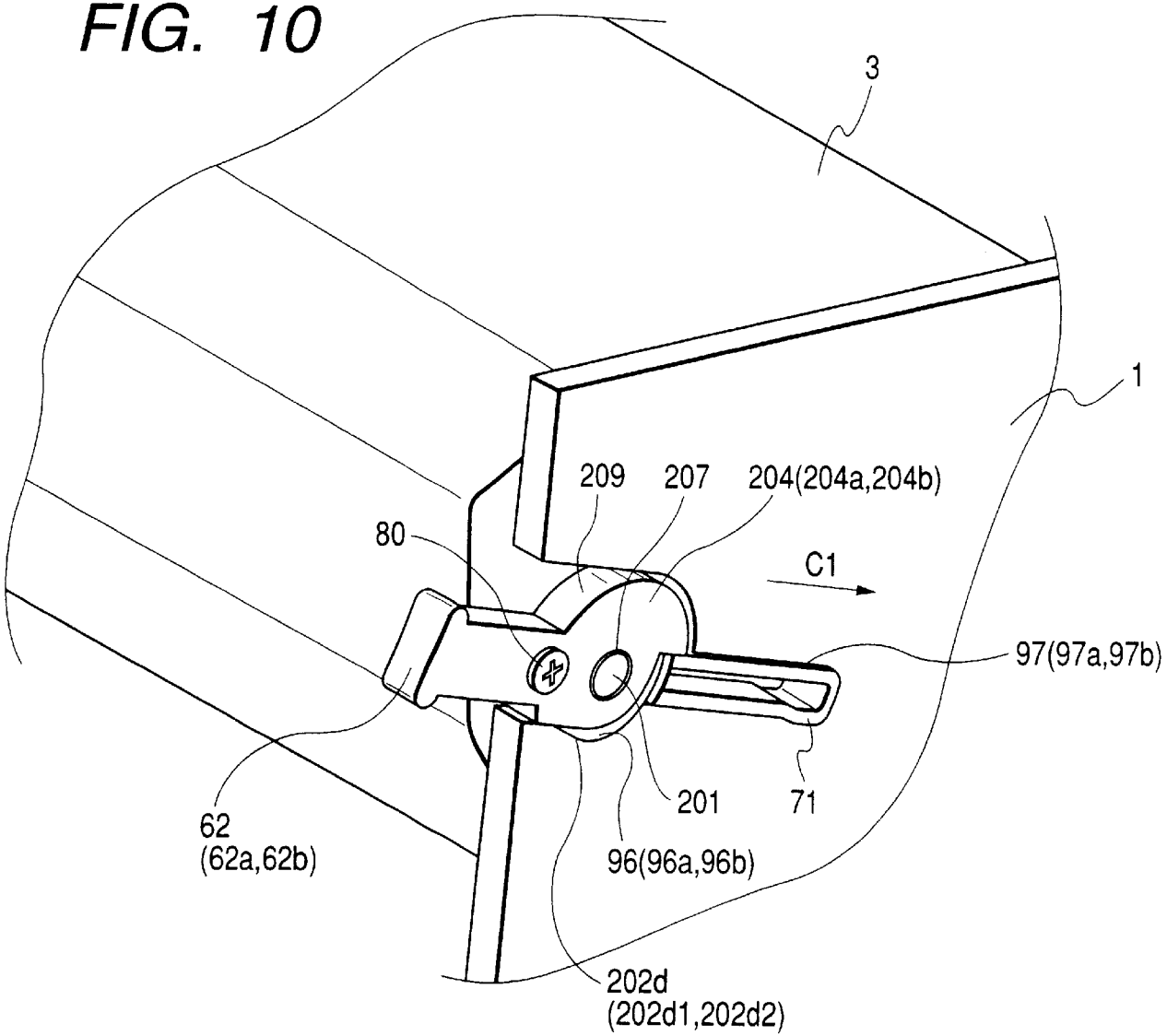
FIG. 10 is a perspective view showing a state in which the process cartridge has been mounted to the apparatus main body.

Here, FIG. 9 is a perspective view showing a state in which the cartridge 3 is to be mounted to the apparatus main body 1. FIG. 10 is a perspective view showing a state in which the cartridge 3 has been mounted to the apparatus main body 1.

One exposed portion of a circumferential face of the bearing member 202 in the process cartridge 3 is engaged with the main body positioning portion 96 formed in the apparatus main body 1. Further, a guide rib portion 71 for preventing an inclination of the process cartridge 3 and guiding the process cartridge 3 in its mounting to the apparatus main body 1 is formed in the cartridge frame 3*a* in each of both end portions in a longitudinal direction of the photosensitive drum 4.

A guide groove 97 (97*a*, 97*b*) for guiding the guide rib portion 71 and regulating the inclination of the process cartridge 3, and the main body positioning portion 96 for positioning the process cartridge 3 are constructed in the apparatus main body 1 (see FIG. 9).

Therefore, the guide rib portion 71 is arranged forward and the process cartridge 3 is inserted into a cartridge mounting portion in the direction indicated by the arrow C1. Thus, the guide rib portion 71 is fitted into the guide groove 97. Therefore, when the process cartridge 3 is further pushed and advanced, the bearing member 202 is fitted into the positioning portion 96 of the apparatus main body 1. A position of the photosensitive drum 4 with respect to the apparatus main body 1 is determined by fitting the bearing member 202 into the positioning portion 96 (see FIG. 10).

The photosensitive drum 4 is positioned with respect to the apparatus main body 1 with high accuracy by engaging the bearing member 202 of the process cartridge 3 with the positioning portion 96 of the apparatus main body 1 in this way. Further, an unillustrated earth contact member is arranged, or the positioning portion 96 is constructed by a conductive member to ground the drum by engaging this positioning portion 96 with the bearing member 202.

In the aforementioned embodiments, the electrophotographic image forming apparatus to which the process cartridge is detachably mountable is described, but the present invention is not limited to this apparatus. For example, the present invention is applied to a supporting frame for supporting the electrophotographic photosensitive drum 4 without process means acting on the electrophotographic photosensitive drum 4, and, similar to the attachment of the electrophotographic photosensitive drum 4 to the aforementioned cartridge frame, the electrophotographic photosensitive drum 4 is attached to the supporting frame. If such a structure is used, the structure can be detachably mountable to the electrophotographic image forming apparatus main body 1 as an electrophotographic photosensitive drum unit.

The aforementioned embodiments are summarized as follows and their explanations will be supplemented.

First, the process cartridge is summarized and its explanation will be supplemented.

A process cartridge 3 detachably mountable to a main body 1 of an electrophotographic image forming apparatus comprises:

an electrophotographic photosensitive drum 4;

process means (at least one of a developing roller 11, a charging roller 5 and a cleaning blade 15) acting on the photosensitive drum 4;

a cartridge frame 3*a* for supporting the photosensitive drum 4;

a first bearing member 202*a* arranged in one end of the frame 3*a* in a longitudinal direction of the photosensitive drum 4, and supporting a shaft 201 projected from the one end of the photosensitive drum in its longitudinal direction;

a first handle 204*a* for gripping the cartridge 3 in its mounting to the apparatus main body 1, and regulating disconnection of the first bearing member 202*a* from the frame 3*a;* a second bearing member 202*b* arranged in the other end of the frame 3*a* in the longitudinal direction of the photosensitive drum 4, and supporting a shaft 201 projected from the other end of the photosensitive drum 4 in its longitudinal direction; and a second handle 204*b* for gripping the cartridge 3 in its mounting to the apparatus main body 1, and regulating disconnection of the second bearing member 202*b* from the frame 3*a*.

The first handle 204*a* has a first regulating portion 204*d*1 coming in contact with an outside face 202*e*1 of the first bearing member 202*a* and regulating the disconnection of the first bearing member 202*a* from the frame 3*a*, and also has a first gripping portion 62*a* for being gripped and extended upstream from the first regulating portion 204*d*1 in a mounting direction (indicated by the arrow C1) of the process cartridge 3 to the apparatus main body 1; and the second handle 204*b* has a second regulating portion 204*d*2 coming in contact with an outside face 202*e*2 of the second bearing member 202*b* and regulating the disconnection of the second bearing member 202*b* from the frame 3*a*, and also has a second gripping portion 62*b* for being gripped and extended upstream from the second regulating portion 204*d*2 in the mounting direction (indicated by the arrow C1) of the process cartridge 3 to the apparatus main body 1.

Further, the first regulating portion 204*d*1 of the first handle 204*a* surrounds a portion of the shaft 201 projected further outward from the first bearing member 202*a* in the longitudinal direction, and the second regulating portion 204*d*2 of the second handle 204*b* surrounds a portion of the shaft 201 projected further outward from the second bearing member 202*b* in the longitudinal direction.

Further, a process cartridge 3 detachably mountable to a main body 1 of an electrophotographic image forming apparatus comprises:

an electrophotographic photosensitive drum 4;

process means (at least one of a developing roller 11, a charging roller 5 and a cleaning blade 15) acting on the electrophotographic photosensitive drum 4;

a cartridge frame 3*a* for supporting the photosensitive drum 4;

a first bearing member 202*a* which is arranged in the cartridge frame 3*a* and rotatably supports a shaft 201 projected from one end of the photosensitive drum 4 in its longitudinal direction, and has a first exposure portion 202*d*1 exposed from the cartridge frame 3*a*; and a second bearing member 202*b* which is arranged in the cartridge frame 3*a* and rotatably supports a shaft 201 projected from the other end of the photosensitive drum 4 in its longitudinal direction, and has a second exposure portion 202*d*2 exposed from said cartridge frame 3*a;* wherein when the cartridge 3 is mounted to the apparatus main body 1, the first exposure portion 202*d*1 of the first bearing member 202*a* comes in contact with a first main body positioning portion 96*a* formed in the apparatus main body 1, and is positioned; and the second exposure portion 202*d*2 of the second bearing member

202*b* comes in contact with a second main body positioning portion 96*b* formed in the apparatus main body 1, and is positioned.

Here, disconnection of the first bearing member 202*a* from the cartridge frame 3*a* is regulated by a first handle 204*a*, and disconnection of the second bearing member 202*b* from the cartridge frame 3*a* is regulated by a second handle 204*b*. The first exposure portion 202*d*1 of the first bearing member 202*a* is exposed from the first handle 204*a*. The second exposure portion 202*d*2 of the second bearing member 202*b* is exposed from the second handle 204*b*. The first handle 204*a* and the second handle 204*b* are arranged to grip the cartridge when the cartridge is mounted to and dismounted from the apparatus main body.

Further, the first handle 204*a* has a first regulating portion 204*d*1 coming in contact with an outside face 202*e*1 of the first bearing member 202*a* and regulating the disconnection of the first bearing member 202*a* from the cartridge frame 3*a*, and also has a first gripping portion 62*a* for being gripped and extended upstream from the first regulating portion 204*d*1 in a mounting direction (indicated by the arrow C1) of the cartridge 3 to the apparatus main body 1; and the second handle 204*b* has a second regulating portion 204*d*2 coming in contact with an outside face 202*e*2 of the second bearing member 202*b* and regulating the disconnection of the second bearing member 202*b* from the cartridge frame 3*a*, and also has a second gripping portion 62*b* for being gripped and extended upstream from the second regulating portion 204*d*2 in the mounting direction (indicated by the arrow C1) of the cartridge 3 to the apparatus main body 1.

Further, the first regulating portion 204*d*1 of the first handle 204*a* surrounds a portion of the shaft 201 projected further outward from the first bearing member 202*a* in the longitudinal direction, and the second regulating portion 204*d*2 of the second handle 204*b* surrounds a portion of the shaft 201 projected further outward from the second bearing member 202*b* in the longitudinal direction.

Further, the first regulating portion 204*d*1 and the first gripping portion 62*a*, and the second regulating portion 204*d*2 and the second gripping portion 62*b* are integrally formed by plastic.

The process means has at least one of a developing member (developing roller 11) for developing an electrostatic latent image formed on the photosensitive drum 4, a charging member (charging roller 5) for charging the photosensitive drum 4, and a cleaning member (cleaning blade 15) for removing toner left on the photosensitive drum 4.

A handle attaching method is next summarized and its explanation will be supplemented as follows.

A handle attaching method for attaching a handle 204 to a cartridge frame 3*a* arranged in a process cartridge 3 comprises;

a bearing member attaching step in which an electrophotographic photosensitive drum shaft 201 projected from one end of the cartridge frame 3*a* in its longitudinal direction is fitted into a hole 207 of a bearing member 202, and the bearing member 202 is next fitted into a concave portion 203 formed in the cartridge frame 3*a*, and the bearing member 202 is attached to the cartridge frame 3*a* so as to expose one portion of the bearing portion 202 from a frame notch portion 3*a*1 formed in the cartridge frame 3*a*; and a handle attaching step for attaching the handle 204 to the cartridge frame 3*a* such that a movement of the bearing member 202 to an outer side is regulated in a longitudinal direction of the drum shaft 201 so as not to disconnect the bearing member 202 from the cartridge frame 3*a*, and a handle notch portion 205 of the handle 204 is opposed to the frame notch portion 3*a*1.

A handle attaching method for attaching a handle 204 to a cartridge frame 3*a* arranged in a process cartridge 3 comprises:

a bearing member attaching step in which an electrophotographic photosensitive drum shaft 201 projected from one end of the cartridge frame 3*a* in its longitudinal direction is fitted into a hole 207 of a bearing member 202, and the bearing member 202 is next fitted into a concave portion 203 formed in the cartridge frame 3*a*, and the bearing member 202 is attached to the cartridge frame 3*a*; and a handle attaching step for attaching the handle 204 to the cartridge frame 3*a* so as to regulate a movement of the bearing member 202 to an outer side in a longitudinal direction of the drum shaft 201 such that no bearing member 202 is disconnected from the cartridge frame 3*a*.

Further, the handle 204 is attached to the cartridge frame 3*a* such that a regulating portion 204*d* of the handle 204 comes in contact with an outside face 202*e* of the bearing member 202 in the handle attaching step, and the handle 204 thus regulates the movement of the bearing member 202.

Further, the bearing member 202 is press-fitted into the concave portion 203 in the bearing member attaching step.

Further, the handle 204 is attached to the cartridge frame 3*a* by a screw in the handle attaching step.

The handle is summarized as follows.

A handle 204 is gripped when a process cartridge 3 detachably mountable to a main body 1 of an electrophotographic image forming apparatus is mounted to and dismounted from the apparatus main body 1, in which the process cartridge 3 has an electrophotographic photosensitive drum 4, process means (at least one of a developing roller 11, a charging roller 5 and a cleaning blade 15) acting on the photosensitive drum, and a cartridge frame 3*a* for supporting the photosensitive drum 4. The handle 204 comprises:

a regulating portion 204*d* for regulating a bearing member 202 so that the bearing member 202 arranged in the frame 3*a* and supporting a shaft 201 projected from an end portion of the photosensitive drum 4 in its longitudinal direction is not disconnected from the frame 3*a* when the handle 204 is attached to the frame 3*a*; and a gripping portion 62 for being gripped and extended upstream from the regulating portion 204*d* in a mounting direction (indicated by the arrow C1) of the process cartridge 3 to the apparatus main body 1.

The regulating portion 204*d* and the gripping portion 62 are integrally formed with each other.

The photosensitive drum 4 is grounded between the process cartridge 3 and the apparatus main body 1 through the bearing member (both or one of 202*a* and 202*b*).

As explained above, in accordance with the present invention, the positioning accuracy of the electrophotographic photosensitive drum with respect to the apparatus main body can be improved when the process cartridge is mounted to the apparatus main body.

Further, in accordance with the present invention, the positioning accuracy of the process cartridge with respect to the apparatus main body can be improved when the process cartridge is mounted to the apparatus main body.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable to a main body of an electrophotographic image forming apparatus, said process cartridge comprising:

an electrophotographic photosensitive drum;

process means acting on said electrophotographic photosensitive drum;

a cartridge frame;

a shaft through which said electrophotographic photosensitive drum is supported by said cartridge frame, said shaft extending through said electrophotographic photosensitive drum;

a first bearing member which is arranged in said cartridge frame and rotatably supports one end of said shaft projected from one end of said photosensitive drum in a longitudinal direction of said photosensitive drum, and which has a first exposure portion exposed from said cartridge frame; and a second bearing member which is arranged in said cartridge frame and rotatably supports the other end of said shaft projected from the other end of said photosensitive drum in the longitudinal direction of said photosensitive drum, and which has a second exposure portion exposed from said cartridge frame;

wherein said first exposure portion of said first bearing member comes in contact with a first main body positioning portion formed in said main body and is positioned, and said second exposure portion of said second bearing member comes in contact with a second main body positioning portion formed in said main body and is positioned when said process cartridge is mounted to said main body.

2. A process cartridge according to claim 1, wherein disconnection of said first bearing member from said cartridge frame is regulated by a first handle, and disconnection of said second bearing member from said cartridge frame is regulated by a second handle, and wherein said first exposure portion of said first bearing member is exposed from said first handle, and said second exposure portion of said second bearing member is exposed from said second handle, and wherein said first handle and said second handle are arranged to grip said cartridge when said cartridge is mounted to and dismounted from said main body.

3. A process cartridge according to claim 1 or 2, wherein said first handle has a first regulating portion coming in contact with an outside face of said first bearing member and regulating disconnection of said first bearing member from said cartridge frame, and also has a first gripping portion for being gripped and extended upstream from said first regulating portion in a mounting direction of said cartridge to said main body, and wherein said second handle has a second regulating portion coming in contact with an outside face of said second bearing member and regulating disconnection of said second bearing member from said cartridge frame, and also has a second gripping portion for being gripped and extended upstream from said second regulating portion in the mounting direction of said cartridge to said main body.

4. A process cartridge according to claim 3, wherein said first regulating portion of said first handle surrounds a portion of said shaft projected further outward from said first bearing member in said longitudinal direction, and said second regulating portion of said second handle surrounds a portion of said shaft projected further outward from said second bearing member in said longitudinal direction.

5. A process cartridge according to claim 3, wherein said first regulating portion and said first gripping portion, and said second regulating portion and said second gripping portion are formed integrally with each other by plastic, respectively.

6. A process cartridge detachably mountable to a main body of an electrophotographic image forming apparatus, said process cartridge comprising:

an electrophotographic photosensitive drum;

process means acting on said electrophotographic photosensitive drum;

a cartridge frame;

a shaft through which said electrophotographic photosensitive drum is supported by said cartridge frame, said shaft extending through said electrophotographic photosensitive drum;

a first handle arranged on one end of said frame in a longitudinal direction of said photosensitive drum:

a second handle arranged on the other end of said frame in the longitudinal direction of said photosensitive drum;

a first bearing member which is arranged in said cartridge frame and rotatably supports one end of said shaft projected from one end of said photosensitive drum in the longitudinal direction, and has a first exposure portion exposed from said cartridge frame and said first handle, wherein said first handle has a first regulating portion coming in contact with an outside face of said first bearing member and regulating disconnection of said first bearing member from said cartridge frame, and also has a first gripping portion for being gripped and extended upstream from said first regulating portion in a mounting direction of said cartridge to said main body; and a second bearing member which is arranged in said cartridge frame and rotatably supports the other end of said shaft projected from the other end of said photosensitive drum in the longitudinal direction, and has a second exposure portion exposed from said cartridge frame and said second handle, wherein said second handle has a second regulating portion coming in contact with an outside face of said second bearing member and regulating disconnection of said second bearing member from said cartridge frame, and also has a second gripping portion for being gripped and extended upstream from said second regulating portion in the mounting direction of said cartridge to said main body, wherein said first exposure portion of said first bearing member comes in contact with a first main body positioning portion formed in said main body and is positioned, and said second exposure portion of said second bearing member comes in contact with a second main body positioning, portion formed in said main body and is positioned when said cartridge is mounted to said main body.

7. A process cartridge according to claim 6, wherein said first regulating portion of said first handle surrounds a portion of said shaft projected further outward from said first bearing member in said longitudinal direction, and said second regulating portion of said second handle surrounds a portion of said shaft projected further outward from said second bearing member in said longitudinal direction.

8. A process cartridge according to claim 6 or 7, wherein said first regulating portion and said first gripping portion, and said second regulating portion and said second gripping portion are formed integrally with each other by plastic, respectively.

9. A process cartridge according to claim 1 or 6, wherein said bearing members are made of a metal.

10. A process cartridge according to claim 1 or 6, wherein said process means has at least one of a developing member for developing an electrostatic latent image formed on said photosensitive drum, a charging member for charging said photosensitive drum, and a cleaning member for removing toner left on said photosensitive drum.

11. An electrophotographic image forming apparatus to which a process cartridge is detachably mountable for forming an image on a recording medium, said electrophotographic image forming apparatus comprising:

(a) a first main body positioning portion;

(b) a second main body positioning portion;

(c) a mounting portion for detachably mounting said process cartridge, said process cartridge having:

an electrophotographic photosensitive drum;

process means acting on said electrophotographic photosensitive drum;

a cartridge frame;

a shaft through which said electrophotographic photosensitive drum is supported by said cartridge frame, said shaft extending through said electrophotographic photosensitive drum;

a first bearing member which is arranged in said cartridge frame and rotatably supports one end of said shaft projected from one end of said photosensitive drum in a longitudinal direction of said photosensitive drum, and which has a first exposure portion exposed from said cartridge frame; and a second bearing member which is arranged in said cartridge frame and rotatably supports the other end of said shaft projected from the other end of said photosensitive drum in the longitudinal direction of said photosensitive drum, and which has a second exposure portion exposed from said cartridge frame, wherein said first exposure portion of said first bearing member comes in contact with said first main body positioning portion and is positioned, and said second exposure portion of said second bearing member comes in contact with said second main body positioning portion and is positioned when said process cartridge is mounted to a main body of said apparatus; and (d) a conveying member for conveying said recording medium.

12. An electrophotographic image forming apparatus to which a process cartridge is detachably mountable for forming an image on a recording medium, said electrophotographic image forming apparatus comprising:

(a) a first main body positioning portion;

(b) a second main body positioning portion;

(c) a mounting portion for detachably mounting said process cartridge, said process cartridge having:

an electrophotographic photosensitive drum;

process means acting on said electrophotographic photosensitive drum;

a cartridge frame;

a shaft through which said electrophotographic photosensitive drum is supported by said cartridge frame, said shaft extending through said electrophotographic photosensitive drum;

a first handle arranged on one end of said frame in a longitudinal direction of said photosensitive drum;

a second handle arranged on the other end of said frame in the longitudinal direction of said photosensitive drum;

a first bearing member which is arranged in said cartridge frame and rotatably supports one end of said shaft projected from one end of said photosensitive drum in the longitudinal direction, and has a first exposure portion exposed from said cartridge frame and said first handle, wherein said first handle has a first regulating portion coming in contact with an outside face of said first bearing member and regulating disconnection of said first bearing member from said cartridge frame, and also has a first gripping portion for being gripped and extended upstream from said first regulating portion in a mounting direction of said cartridge a main body of said apparatus; and a second bearing member which is arranged in said cartridge frame and rotatably supports the other end of said shaft projected from the other end of said photosensitive drum in the longitudinal direction, and has a second exposure portion exposed from said cartridge frame and said second handle, wherein said second handle has a second regulating portion coming in contact with an outside face of said second bearing member and regulating disconnection of said second bearing member from said cartridge frame, and also has a second gripping portion for being gripped and extended upstream from said second regulating-portion in the mounting direction of said cartridge to a main body, wherein said first exposure portion of said first bearing member comes in contact with said first main body positioning portion and is positioned, and said second exposure portion of said second bearing member comes in contact with said second main body positioning portion and is positioned when said process cartridge is mounted to said main body; and (d) a conveying member for conveying said recording medium.

13. A handle attaching method of attaching a handle to a cartridge frame arranged in a process cartridge, said method comprising:

a bearing member attaching step in which one end of a shaft projected from one end of said cartridge frame in a longitudinal direction of said cartridge frame is fitted into a hole of a bearing member, said shaft extending through an electrophotographic photosensitive drum, and said bearing member is next fitted into a concave portion formed in said cartridge frame, and said bearing member is attached to said cartridge frame so as to expose one portion of said bearing member from a frame notch portion formed in said cartridge frame; and a handle attaching step of attaching said handle to said cartridge frame such that a movement of said bearing member to an outer side is regulated in a longitudinal direction of said shaft so as not to disconnect said bearing member from said cartridge frame, and a handle notch portion formed in said handle is opposed to said frame notch portion.

14. A handle attaching method according to claim 13, wherein said handle is attached to said cartridge frame such that a regulating portion of said handle comes in contact with an outside face of said bearing member in said handle attaching step, thereby said handle regulates the movement of said bearing member.

15. A handle attaching method according to claim 13 or 14, wherein said bearing member is press-fitted into said concave portion in said bearing member attaching step.

16. A handle attaching method according to claim 13 or 14, wherein said handle is attached to said cartridge frame by a screw in said handle attaching step.

17. A process cartridge according to claim 1 or 6, wherein said process cartridge has toner for developing an electrostatic latent image formed on said photosensitive drum.

18. A process cartridge according to claim 1 or 6, wherein said photosensitive drum is grounded between said process cartridge and said main body through both or one of said first and second bearing members.

19. A process cartridge detachably mountable to a main body of an electrophotographic image forming apparatus, said process cartridge comprising:

an electrophotographic photosensitive drum;

a developing roller for developing an electrostatic latent image formed on said electrophotographic photosensitive drum;

a charging roller for charging said electrophotographic photosensitive drum;

a cartridge frame;

a shaft through which said electrophotographic photosensitive drum is supported by said cartridge frame, said shaft extending through said electrophotographic photosensitive drum;

a first handle arranged on one end of said frame in a longitudinal direction of said photosensitive drum:

a second handle arranged on the other end of said frame in the longitudinal direction of said photosensitive drum;

a first bearing member which is arranged in said cartridge frame and rotatably supports one end of said shaft projected from one end of said photosensitive drum in the longitudinal direction, and has a first exposure portion exposed from said cartridge frame and said first handle, wherein said first handle has a first regulating portion coming in contact with an outside face of said first bearing member and regulating disconnection of said first bearing member from said cartridge frame, and also has a first gripping portion for being gripped and extended upstream from said first regulating portion in a mounting direction of said cartridge to said main body; and a second bearing member which is arranged in said cartridge frame and rotatably supports the other end of said shaft projected from the other end of said photosensitive drum in the longitudinal direction, and has a second exposure portion exposed from said cartridge frame and said second handle, wherein said second handle has a second regulating portion coming in contact with an outside face of said second bearing member and regulating disconnection of said second bearing member from said cartridge frame, and also has a second gripping portion for being gripped and extended upstream from said second regulating portion in the mounting direction of said cartridge to said main body, wherein said first exposure portion of said first bearing member comes in contact with a first main body positioning portion formed in said main body and is positioned, and said second exposure portion of said second bearing member comes in contact with a second main body positioning, portion formed in said main body and is positioned when said cartridge is mounted to said main body, wherein said first regulating portion of said first handle surrounds a portion of said shaft projected further outward from said first bearing member in said longitudinal direction, and said second regulating portion of said second handle surrounds a portion of said shaft projected further outward from said second bearing member in said longitudinal direction, wherein said first regulating portion and said first gripping portion, and said second regulating portion and said second gripping portion are formed integrally with each other by plastic, respectively, and wherein said bearing members are made of a metal.

20. The process cartridge according to claim 19, further comprising a cleaning member for removing toner left on said photosensitive drum.

21. A process cartridge according to claim 19, wherein said process cartridge has toner for developing an electrostatic latent image formed on said photosensitive drum.

22. A process cartridge according to claim 19, wherein said photosensitive drum is grounded between said process cartridge and said main body through both or one of said first and second bearing members.

23. An electrophotographic image forming apparatus to which a process cartridge is detachably mountable for forming an image on a recording medium, said electrophotographic image forming apparatus comprising:

(a) a first main body positioning portion;

(b) a second main body positioning portion;

(c) a mounting portion for detachably mounting said process cartridge, said process cartridge having:

an electrophotographic photosensitive drum;

a developing roller for developing an electrostatic latent image formed on said electrophotographic photosensitive drum;

a charging roller for charging said electrophotographic photosensitive drum;

a cartridge frame;

a shaft through which said electrophotographic photosensitive drum is supported by said cartridge frame, said shaft extending through said electrophotographic photosensitive drum;

a first handle arranged on one end of said frame in a longitudinal direction of said photosensitive drum:

a second handle arranged on the other end of said frame in the longitudinal direction of said photosensitive drum;

a first bearing member which is arranged in said cartridge frame and rotatably supports one end of said shaft projected from one end of said photosensitive drum in the longitudinal direction, and has a first exposure portion exposed from said cartridge frame and said first handle, wherein said first handle has a first regulating portion coming in contact with an outside face of said first bearing member and regulating disconnection of said first bearing member from said cartridge frame, and also has a first gripping portion for being gripped and extended upstream from said first regulating portion in a mounting direction of said cartridge to said main body; and a second bearing member which is arranged in said cartridge frame and rotatably supports the other end of said shaft projected from the other end of said photosensitive drum in the longitudinal direction, and has a second exposure portion exposed from said cartridge frame and said second handle, wherein said second handle has a second regulating portion coming in contact with an outside face of said second bearing member and regulating disconnection of said second bearing member from said cartridge frame, and also has a second gripping portion for being gripped and extended upstream from said second regulating portion in the mounting direction of said cartridge to said main body, wherein said first exposure portion of said first bearing member comes in contact with a first main body positioning portion formed in said main body and is positioned, and said second exposure portion of said second bearing member comes in contact with a second main body positioning, portion formed in said main body and is positioned when said cartridge is mounted to said main body, wherein said first regulating portion of said first handle surrounds a portion of said shaft projected further outward from said first bearing member in said longitudinal direction, and said second regulating portion of said second handle surrounds a portion of said shaft projected further outward from said second bearing member in said longitudinal direction, wherein said first regulating portion and said first gripping portion, and said second regulating portion and said second gripping portion are formed integrally with each other by plastic, respectively, and wherein said bearing members are made of a metal; and (d) a conveying member for conveying said recording medium.

24. A handle attaching method of attaching a handle to a cartridge frame arranged in a process cartridge, said method comprising:

a bearing member attaching step in which one end of a shaft projected from one end of said cartridge frame in a longitudinal direction of said cartridge frame is fitted into a hole of a bearing member, said shaft extending through an electrophotographic photosensitive drum, and said bearing member is next fitted into a concave portion formed in said cartridge frame, and said bearing member is attached to said cartridge frame so as to expose one portion of said bearing member from a frame notch portion formed in said cartridge frame; and a handle attaching step of attaching said handle to said cartridge frame such that a movement of said bearing member to an outer side is regulated in a longitudinal direction of said shaft so as not to disconnect said bearing member from said cartridge frame, and a handle notch portion formed in said handle is opposed to said frame notch portion, wherein said handle is attached to said cartridge frame such that a regulating portion of said handle comes in contact with an outside face of said bearing member in said handle attaching step, thereby said handle regulates the movement of said bearing member, wherein said bearing member is press-fitted into said concave portion in said bearing member attaching step, and wherein said handle is attached to said cartridge frame by a screw in said handle attaching step.

25. A process cartridge detachably mountable to a main body of an electrophotographic image forming apparatus, said process cartridge comprising:

an electrophotographic photosensitive drum;

process means acting on said electrophotographic photosensitive drum;

a cartridge frame for supporting said photosensitive drum;

a first handle arranged on one end of said cartridge frame in a longitudinal direction of said photosensitive drum, said first handle to be gripped when said process cartridge is mounted to and detached from said main body;

a second handle arranged on the other end of said cartridge frame in the longitudinal direction of said photosensitive drum, said second handle to be gripped when said process cartridge is mounted to and detached from said main body;

a first bearing member for supporting rotatably a shaft projected from one end of said photosensitive drum in the longitudinal direction of said photosensitive drum, said first bearing member being arranged in said cartridge frame to expose a portion of said first bearing member from said cartridge frame and said first handle; and a second bearing member for supporting rotatably a shaft projected from the other end of said photosensitive drum in the longitudinal direction of said photosensitive drum, said second bearing member being arranged in said cartridge frame to expose a portion of said second bearing member from said cartridge frame and said second handle, wherein when said process cartridge is mounted to said main body, the exposed portion of said first bearing member comes in contact with a first main body positioning portion formed in said main body, and the exposed portion of said second bearing member comes in contact with a second main body positioning portion formed in said main body so that said process cartridge is positioned in said main body.

26. A process cartridge according to claim 25, wherein disconnection of said first bearing member from said cartridge frame is regulated by said first handle, and disconnection of said second bearing member from said cartridge frame is regulated by said second handle.

27. A process cartridge according to claim 25 or 26, wherein said first handle has a first regulating portion coming in contact with an outside face of said first bearing member and regulating disconnection of said first bearing member from said cartridge frame, and also has a first gripping portion for being gripped and extended upstream from said first regulating portion in a mounting direction of said cartridge to said main body, and wherein said second handle has a second regulating portion coming in contact with an outside face of said second bearing member and regulating disconnection of said second bearing member from said cartridge frame, and also has a second gripping portion for being gripped and extended upstream from said second regulating portion in the mounting direction of said cartridge to said main body.

28. A process cartridge according to claim 27, wherein said first regulating portion of said first handle surrounds a portion of said shaft projected further outward from said first bearing member in said longitudinal direction, and said second regulating portion of said second handle surrounds a portion of said shaft projected further outward from said second bearing member in said longitudinal direction.

29. A process cartridge according to claim 28, wherein said first regulating portion and said first gripping portion, and said second regulating portion and said second gripping portion are formed integrally with each other by plastic, respectively.

30. An electrophotographic image forming apparatus to which a process cartridge is detachable mountable for forming an image on a recording medium, said electrophotographic image forming apparatus comprising:

(a) a first main body positioning portion;

(b) a second main body positioning portion;

(c) a mounting portion for detachably mounting said process cartridge, said process cartridge having:

an electrophotographic photosensitive drum;

process means acting on said electrophotographic photosensitive drum;

a cartridge frame for supporting said photosensitive drum;

a first handle arranged on one end of said cartridge frame in a longitudinal direction of said photosensitive drum, said first handle to be gripped when said process cartridge is mounted to and detached from a main body of said apparatus;

a second handle arranged on the other end of said cartridge frame in the longitudinal direction of said photosensitive drum, said second handle to be gripped when said process cartridge is mounted to and detached from said body;

a first bearing member for supporting rotatable a shaft projected from one end of said photosensitive drum in the longitudinal direction of said photosensitive drum, said first bearing member being arranged in said cartridge frame to expose a portion of said first bearing member from said cartridge frame and said first handle; and a second bearing member for supporting rotatably a shaft projected from the other end of said photosensitive drum in the longitudinal direction of said photosensitive drum, said second bearing member being arranged in said cartridge frame to expose a portion of said second bearing member from said cartridge frame and said second handle, wherein when said process cartridge is mounted to said main body, the exposed portion of said first bearing member comes in contact with said first main body positioning portion, and the exposed portion of said second bearing member comes in contact with said second main body positioning portion so that said process cartridge is positioned in said main body; and (d) a conveying member for conveying said recording medium.

* * * * *

UNITED STATES PATENT AND TRADEMARK OFFICE

CERTIFICATE OF CORRECTION

PATENT NO. : 6,480,687 B1
DATED : November 12, 2002
INVENTOR(S) : Tachio Kawai et al.

It is certified that error appears in the above-identified patent and that said Letters Patent is hereby corrected as shown below:

Title page,
Item [56], References Cited, FOREIGN PATENT DOCUMENTS,
"07-160172 * 9/1995" should read -- 07-160172 * 6/1995 --.
Item [57], ABSTRACT,
Line 14, "frame;." should read -- frame. --.

Column 6,
Line 15, "FIG. 6.)" should read -- FIG. 6). --.

Column 14,
Line 12, "cartridge a" should read -- cartridge to a --.

Column 19,
Line 22, "rotatable" should read -- rotatably --.

Signed and Sealed this

Twenty-sixth Day of August, 2003

JAMES E. ROGAN
*Director of the United States Patent and Trademark Office*